US012747084B2

(12) United States Patent
Blankenhorn

(10) Patent No.: US 12,747,084 B2
(45) Date of Patent: Sep. 29, 2026

(54) CONTAINER WITH AN OXYGEN ABSORBER

(71) Applicant: Desiccare, Inc., Las Vegas, NV (US)

(72) Inventor: Benjamin Edward Blankenhorn, Las Vegas, NV (US)

(73) Assignee: INTEGRA SPECIALTY PRODUCTS, INC., Las Vegas, NV (US)

( * ) Notice: Subject to any disclaimer, the term of this patent is extended or adjusted under 35 U.S.C. 154(b) by 44 days.

(21) Appl. No.: 17/000,013

(22) Filed: Aug. 21, 2020

(65) Prior Publication Data

US 2022/0055817 A1 Feb. 24, 2022

(51) Int. Cl.

| | |
|---|---|
| ***B65D 81/26*** | (2006.01) |
| ***B65D 1/36*** | (2006.01) |
| ***B65D 25/54*** | (2006.01) |
| ***B65D 77/20*** | (2006.01) |

(52) U.S. Cl.

CPC ..... *B65D 81/268* (2013.01); *B65D 1/36* (2013.01); *B65D 25/54* (2013.01); *B65D 77/2024* (2013.01)

(58) Field of Classification Search

CPC .. B65D 81/266; B65D 81/267; B65D 81/268; B65D 1/36; B65D 77/2024

USPC ..... 206/524.4, 204

See application file for complete search history.

(56) References Cited

U.S. PATENT DOCUMENTS 5,241,149 A * 8/1993 Watanabe ..... B32B 5/18 219/725
5,698,250 A * 12/1997 DelDuca ..... B65D 77/003 426/396
6,716,276 B2 4/2004 Loop et al.
6,977,589 B2 12/2005 Loop et al.
8,048,201 B2 11/2011 Dukes et al.
8,771,770 B1 * 7/2014 Crump ..... B01J 20/3204 206/205
9,616,381 B2 4/2017 Glorioso et al.
9,616,382 B2 4/2017 Glorioso et al.

(Continued)

FOREIGN PATENT DOCUMENTS

AU 2016306583 A1 3/2018
CA 2697866 A1 9/2010

(Continued)

OTHER PUBLICATIONS

Extended European Search Report for Application No. 21192592.0, dated Jan. 14, 2022, 8 pages.

*Primary Examiner* — Robert Poon

(74) *Attorney, Agent, or Firm* — Womble Bond Dickinson (US) LLP

(57) ABSTRACT

A container including a tray, an oxygen absorber, and a removable film. The tray includes a base, at least one sidewall extending in a first direction from the base, and at least one partition extending in the first direction from the base. The partition divides an interior of the tray into at least a first compartment and a second compartment adjacent to the first compartment. The container also includes at least one aperture in the at least partition. The aperture places the first compartment in fluid communication with the second compartment. The oxygen absorber is in the first compartment or the second compartment, and the removable film covers the first compartment and the second compartment.

16 Claims, 3 Drawing Sheets

(56) References Cited

U.S. PATENT DOCUMENTS

| | | | | |
|---|---|---|---|---|
| 9,618,456 | B2 | 4/2017 | Glorioso et al. | |
| 2001/0000732 | A1* | 5/2001 | Hopkins, Sr. | A23L 5/15<br>219/733 |
| 2007/0163910 | A1* | 7/2007 | Bonnette | B65D 79/02<br>206/459.1 |
| 2009/0186132 | A1* | 7/2009 | Mangino | B65D 1/36<br>426/120 |
| 2011/0243483 | A1* | 10/2011 | Crump | B65D 85/816<br>383/113 |
| 2015/0307257 | A1* | 10/2015 | Padda | B65D 43/22<br>206/204 |
| 2017/0101219 | A1* | 4/2017 | Bloom | B65D 25/005 |
| 2018/0134451 | A1 | 5/2018 | Chen | |

FOREIGN PATENT DOCUMENTS

| | | | |
|---|---|---|---|
| DK | 3334523 | T3 | 8/2020 |
| EP | 0 861 602 | A1 | 9/1998 |
| EP | 3334523 | B1 | 5/2020 |
| HU | E050122 | T2 | 8/2016 |
| JP | H02 258583 | A | 10/1990 |
| JP | H06 98736 | A | 4/1994 |
| WO | 2017/027756 | A1 | 2/2017 |

* cited by examiner

CONTAINER WITH AN OXYGEN ABSORBER

BACKGROUND

1. Field

The present disclosure relates generally to containers having an oxygen absorber.

2. Description of Related Art

Containers are commonly utilized to ship and store products that are susceptible to damage or quality degradation due to various environmental conditions, such as heat and humidity. For instance, products that are susceptible to quality degradation when exposed to moisture in the air may be packaged in a vacuum sealed container. The process of vacuum packing includes placing one or more products inside a sealable and flexible container, such as a plastic film pouch, drawing air out of the container, and then sealing the container. The vacuum packing process may be performed by external sealers, single or double vacuum chamber machines, or automatic belt vacuum chamber machines. However, vacuum packing is costly, susceptible to defective seals, and limits product throughput during manufacturing. Other packaging utilized to protect products against moisture in the air includes shrink film. However, shrink film is susceptible to damage during transportation and storage and may not have sufficient integrity to hold multiple products together.

SUMMARY

The present disclosure is directed to various embodiments of a container. In one embodiment, the container includes a tray having a base, at least one sidewall extending in a first direction from the base, and at least one partition extending in the first direction from the base. The at least one partition divides an interior of the tray into at least a first compartment and a second compartment adjacent to the first compartment. The tray also includes at least one aperture in the at least one partition. The first compartment is in fluid communication with the second compartment through the at least one aperture in the partition. The container also includes an oxygen absorber in one of the first compartment or the second compartment, and a removable film covering the first compartment and the second compartment.

The removable film may be sealed to each of the at least one sidewall and the at least one partition.

The at least one aperture may be a notch in an end of the at least one partition distal to the base.

The oxygen absorber may be in the second compartment, and the second compartment may be volumetrically smaller than the first compartment.

The at least one sidewall may include a pair of opposing sidewalls, and a pair of opposing end walls connected to the pair of opposing sidewalls.

The container may also include a removable lid covering the removable film.

The container may also include an oxygen indicator in the one of the first compartment or the second compartment.

The oxygen absorber may include a mixture of iron powder and sodium chloride in a porous sachet.

The mixture may also include activated carbon.

The container may also include a product in the other one of the first compartment or the second compartment.

The product may include a plant extract, such as nicotine.

The product may be a cosmetic product (e.g., blush or eye shadow in a compact).

The removable film may be translucent or transparent.

The at least one partition may include the same material as the at least one sidewall.

The at least one partition may be thicker than the at least one sidewall.

The at least one partition may have a higher specific heat than the at least one sidewall.

The present disclosure is also directed to various embodiments of a container. In one embodiment, the container includes a tray including a first compartment, a second compartment, a partition separating the first compartment from the second compartment, at least one product in the first compartment, and an oxygen absorber in the second compartment. The partition is configured to permit air in the first compartment to flow into the second compartment through the partition. The oxygen absorber is configured to reduce an amount of the air in the first compartment by an oxidation reaction. The partition is configured to mitigate against a transfer of heat from the second compartment to the first compartment during the oxidation reaction.

The container may include a film covering the first compartment and the second compartment. The film is configured to prevent air outside of the container from entering the first compartment or the second compartment.

The tray may include a base, at least one sidewall extending from the base, and at least one partition extending from the base. The at least one partition divides an interior of the tray into the first compartment and the second compartment.

The present disclosure is also directed to various methods of manufacturing a container. In one embodiment, the method includes inserting at least one product into a first compartment of a tray, inserting an oxygen absorber into a second compartment of the tray separated from the first compartment by at least one partition, and sealing the at least one product in the first compartment and the oxygen absorber in the second compartment with a film. The partition is configured to permit air in the first compartment to flow into the second compartment through the partition. The oxygen absorber is configured to reduce an amount of the air in the first compartment by an oxidation reaction. The partition is configured to mitigate against a transfer of heat from the second compartment to the first compartment during the oxidation reaction. The film is configured to prevent air outside of the container from entering the first compartment or the second compartment.

The method may also include forming at least one aperture in the partition. The at least one aperture places the first compartment in fluid communication with the second compartment.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

The accompanying drawings, together with the specification, illustrate exemplary embodiments of the present disclosure, and, together with the description, serve to explain the principles of the present disclosure.

DETAILED DESCRIPTION

Figure 1:
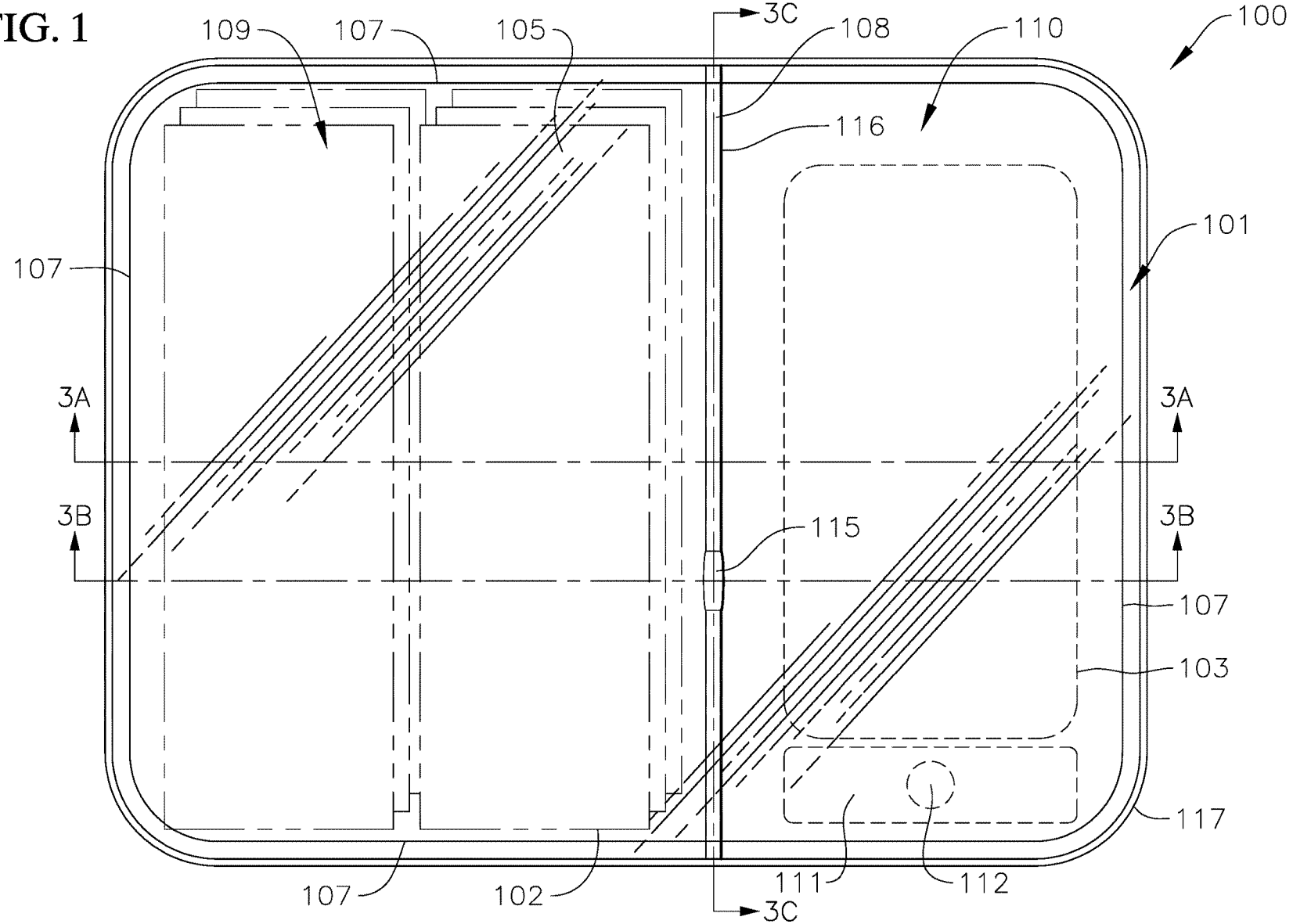
FIG. 1 is a top view of a container according to one embodiment of the present disclosure.
Figures 2, 3A, 3B, 3C:
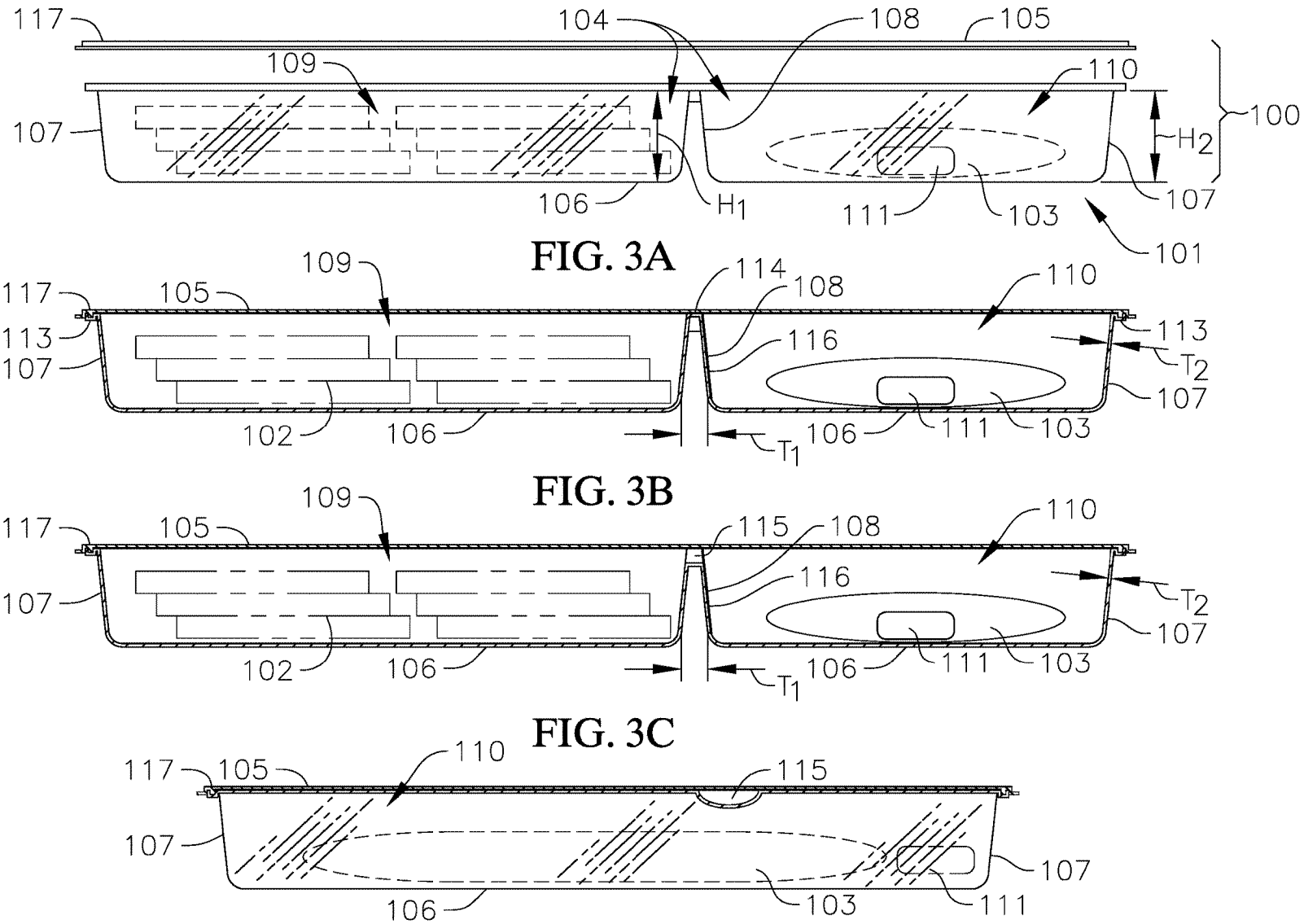
FIG. 2 is an exploded side view of the embodiment of the container illustrated in FIG. 1.
FIGS. 3A-3C are cross-sectional views of the embodiment of the container illustrated in FIG. 1.

The present disclosure is directed to various embodiments of a multi-chamber or multi-compartment container including an oxygen absorber in one of the compartments, a product contained in another one of the compartments, and a partition separating the first compartment from the second compartment. The partition is breathable such that the first compartment is in fluid communication with the second compartment through the partition. Accordingly, air contained in the compartment containing the product may flow through the partition and into the compartment containing the oxygen absorber, and any moisture contained in the air may oxidize the oxygen absorber, which consumes and reduces the concentration of oxygen in the air. In this manner, the oxygen absorber is configured to reduce the concentration of oxygen inside the container, which might otherwise damage or degrade the quality of the product contained in first compartment of the container. Additionally, in one or more embodiments, the partition acts as a thermal insulator and/or a heat sink to protect the product housed in the container against excessive heat generated by the oxygen absorber during the oxidation process, which might otherwise damage or degrade the quality of the product housed in the container.

With reference now to FIGS. 1-3C, a container 100 according to one embodiment of the present disclosure includes a tray 101, one or more products 102 and an oxygen absorber 103 housed in an interior 104 of the tray 101, and a film 105 covering the one or more products 102 and the oxygen absorber 103 in the interior 104 of the tray.

In the illustrated embodiment, the tray 101 includes a base 106 (e.g., a flat or generally flat base wall), at least one sidewall 107 extending from the base 106, and at least one partition 108 extending from the base 106. In the illustrated embodiment, the at least one sidewall 107 and the at least one partition 108 extend in the same direction (e.g., upward) from the base 106. In the illustrated embodiment, the base 106 and the at least one sidewall 107 together define the interior 104 of the tray 101, and the at least one partition 108 divides or separates the interior 104 of the tray 101 into a first compartment (or first chamber) 109 and a second compartment (or second chamber) 110 adjacent to the first compartment 109 (e.g., the tray 101 includes first and second compartments 109, 110 on opposite sides of the partition 108). In one or more embodiment, the partition 108 may divide the interior 104 of the tray 101 into any other desired number of compartments (e.g., one or more partitions may divide the interior 104 of the tray 101 into three or more compartments).

In one or more embodiments, a height $H_1$ of the partition 108 is substantially equal to a height $H_2$ of the at least one sidewall 107, although in one or more embodiments, the height $H_1$ of the partition 108 may be different than the height $H_2$ of the at least one sidewall 107 (e.g., the height $H_1$ of the partition 108 may be greater than or less than the height $H_2$ of the at least one sidewall 107).

In the illustrated embodiment, the base 106 is generally rectangular and the at least one sidewall 107 includes a pair of opposing sidewalls and a pair of opposing end walls arranged in a rectangular configuration. In one or more embodiments, the tray 101 may have any other shape. For instance, in one or more embodiments, the base 106 of the tray 101 may be any other suitable polygonal shape, such as, for example, triangular, square, pentagonal, or hexagonal. In one or more embodiments, the number and arrangement of the sidewalls may depend on the configuration (e.g., shape and size) of the base 106. For instance, in one or more embodiments in which the base 106 is circular, the at least one sidewall 107 may be a single cylindrical sidewall.

Additionally, in the illustrated embodiment, the one or more products 102 are housed in the first compartment 109 and the oxygen absorber (i.e., the oxygen scavenger) 103 is housed in the second compartment 110 such that the one or more products 102 are separated from the oxygen absorber 103 by the partition 108. In one or more embodiments, one or more of the products 102 housed in the first compartment 109 includes one or more plant extracts, such as nicotine (e.g., the products 102 may be liquid nicotine cartridges for use with vaporizers). In one or more embodiments, one or more of the products 102 housed in the first compartment 109 is a cosmetic product (e.g., a compact including blush or eye shadow). In one or more embodiments, the one or more products 102 may be any other kind or type of products, such as, for instance, any other type or kind of products that are susceptible to damage or degradation of quality when exposed to oxygen and/or moisture.

In the illustrated embodiment, the second compartment 110 that houses the oxygen absorber 103 is smaller (e.g., volumetrically smaller) than the first compartment 109 that houses the one or more products 102. In one or more embodiments, the first and second compartments 109, 110 may have any other suitable relative sizes depending, for instance, on the size of the one or more products 102 housed in the first compartment 109, the size of the oxygen absorber 103 housed in the second compartment 110, and the overall size of the tray 101. In one or more embodiments, the size of the second compartment 110 that houses the oxygen absorber 103 may be selected depending on the amount (e.g., volume or exposed surface area) of the oxygen absorber 103 that is required to oxidize a sufficient amount of the oxygen in the interior of the tray 101 to protect the one or more products 102 against damage or degradation of quality when exposed to oxygen and/or moisture. In general, the size of the oxygen absorber 103 and thus the size of the second compartment 110 that accommodates the oxygen absorber 103 increases with increasing size of the first compartment 109 (e.g., increasing overall size of the products 102) such the larger oxygen absorber 103 is capable of oxidizing the increased volume of air in the interior 104 of the tray 101. For instance, in one or more embodiments, the first compartment 109 may be the same or substantially the same size (e.g., the same or substantially the same volume) as the second compartment 110. In one or more embodiments, the second compartment 110 that houses the oxygen absorber 103 may be larger (e.g., volumetrically larger) than the first compartment 109 that houses the one or more products 102.

In one or more embodiments, the oxygen absorber 103 includes a mixture of ferrous carbonate (e.g., iron powder) and a metal halide catalyst (e.g., sodium chloride) in a porous sachet or porous packet. The ferrous carbonate (e.g., iron powder) in the mixture is configured to oxidize when exposed to moisture in the air (i.e., moisture in the air activates the ferrous carbonate), and this oxidation process consumes oxygen in the air and thereby reduces the overall concentration of oxygen in the air. The metal halide catalyst (e.g., sodium chloride) in the mixture, which acts as a catalyst or activator for the oxidation process, reduces the minimum threshold of moisture in the air required to activate the oxidation of the ferrous carbonate. In one or more embodiments, the mixture may include any other suitable catalyst or activator. Additionally, in one or more embodiments, the mixture may also include activated carbon, which is configured to adsorb other gases and some organic molecules. In one or more embodiments, the oxygen absorber 103 may include any other suitable material or materials. For instance, in one or more embodiments, the oxygen absorber 103 may include non-ferrous materials, such as, for example, ascorbate, sodium hydrogen carbonate, citrus, and/or ascorbic acid, and/or any other materials suitable, for example, to mitigate against odor or degradation to the flavor profile of the one or more products 102.

In one or more embodiments, the container 100 may also include an oxygen indicator 111 in the second compartment 110 (i.e., the second compartment 110 of the tray 101 may house both the oxygen absorber 103 and the oxygen indicator 111). In one or more embodiments, the oxygen indicator 111 is a visual indicator of the presence of oxygen in the interior 104 of the container 100 above a threshold limit. Accordingly, the oxygen indicator 111 may be utilized to determine if the film 105 is sealed to the tray 101 properly and if the oxygen absorber 103 is functioning properly to remove the oxygen from the interior 104 of the tray 101. For instance, in one or more embodiments, the oxygen indicator 111 may include a visual indicator portion 112 (e.g., a circular portion, such as a dot) configured to change color when oxygen is present inside the interior 104 of the tray 101 above the threshold limit (e.g., the visual indicator portion 112 of the oxygen indicator 111 may be configured to change from pink or a reddish hue color when the oxygen level in the interior 104 of the tray 101 is below the threshold limit to blue when the oxygen level in the interior 104 of the tray 101 is above the threshold limit). In one or more embodiments, the film 105 may be translucent or transparent, in whole or in part, to enable a user to view the oxygen indicator 111, or at least the visual indicator portion 112 of the oxygen indicator 111, housed in the second compartment 110 of the tray 101. In one or more embodiments, the container 100 may be provided without the oxygen indicator 111.

In the illustrated embodiment, the film 105 of the container 100 covers the first and second compartments 109, 110 of the tray 101 and forms a fluid-tight seal with the tray 101 sealing the one or more products 102 in the first compartment 109 and sealing the oxygen absorber 103 and, optionally, the oxygen indicator 111 in the second compartment 110. The film 105 is removable to enable access to the one or more products 102 housed in the first compartment 109. In one or more embodiments, the film 105 may be sealed (e.g., heat sealed and/or bonded with adhesive) to an upper end 113 of each of the one or more sidewalls 107 and an upper end 114 of the partition 108. In one or more embodiments, the film 105 is sealed along the entirety of the at least one sidewall 107 (e.g., along the entire periphery of the tray 101) such that air from the surrounding atmosphere (the exterior of the container 100) cannot enter the interior 104 of the tray 101. The film 105 may be formed of any suitable material, such as, for instance, biaxially-oriented polyethylene terephthalate (BoPET). In one or more embodiments, the film 105 (or at least a portion thereof) may be translucent or transparent to enable a user to view the one or more products 102 housed in the first compartment 109 and/or the oxygen indicator 111 (or at least the visual indicator portion 112 of the oxygen indicator 111) housed in the second compartment 110.

In the illustrated embodiment, the partition 108 is breathable such that the first compartment 109 is in fluid communication with the second compartment 110 through the partition 108. In one or more embodiments, the partition 108 includes one or more apertures 115 (e.g., one or more openings) placing the first compartment 109 in fluid communication with the second compartment 110. In the illustrated embodiment, the aperture 115 is a notch along an end 114 (e.g., an upper edge) of the partition 108 distal to the base 106 (e.g., the notch is located at a first end of the partition 108 opposite to a second end of the partition 108 coupled to the base 106). The notch 115 may have any suitable shape, such as, for instance, a curved shape (e.g., an arcuate shape) or a polygonal shape (e.g., rectangular). In the illustrated embodiment, the notch forms a gap between the partition 108 and the film 105 through which air may flow from the first compartment 109 to the second compartment 110. Additionally, in the illustrated embodiment, the film 105 is sealed (e.g., heat sealed and/or bonded with adhesive) along an entirety of the length of the upper end 114 of the partition 108 except at the aperture 115 (e.g., the notch) such that air in the first compartment 109 cannot flow into the second compartment 110 except through the aperture 115 in the upper end 114 of the partition 108. In one or more embodiments, the aperture 115 may be an opening (e.g., a hole) along any portion of the partition 108. In one or more embodiments, the partition 108 may be a liquid-tight but air-permeable membrane and the apertures 115 in the partition 108 may be the porosity of the membrane partition 108 that permits air to pass through the membrane partition 108. In one or more embodiments, the partition 108 may be an air-permeable open-cell material, such as open cell foam, and the apertures 115 in the partition 108 may be the open cells, pores, or voids in the open-cell material.

As described above, the air in the first compartment 109 housing the one or more products 102 is configured to flow through the aperture 115 in the partition 108 and into the second compartment 110 housing the oxygen absorber 103. When the ferrous carbonate (e.g., iron powder) in the oxygen absorber 103 is exposed to moisture in the air, the ferrous carbonate is configured to oxidize (i.e., moisture in the air activates the ferrous carbonate), and this oxidation process consumes oxygen in the air and thereby reduces the overall concentration of oxygen in the air trapped inside the interior 104 of the tray 101. Moreover, as the air in the first compartment 109 flows into the second compartment 110 through the aperture 115 in the partition 108 and is consumed by the oxygen absorber 103, moisture in the air is drawn away from the one or more products 102 housed in the first compartment 109. In one or more embodiments, the moisture in the air may condense and form condensate on the portion of the film 105 covering the second compartment 110 that houses the oxygen absorber 103. In this manner, the container 100 is configured to protect the one or more products 102 against damage or degradation of quality, which might otherwise occur when the one or more products 101 are exposed to oxygen and/or moisture. Additionally, the oxidation of the ferrous carbonate (e.g., iron powder) in the oxygen absorber 103 is an exothermic reaction.

In the illustrated embodiment, the partition 108 functions as a thermal insulator and/or a heat sink configured to protect the one or more products 102 contained in the first compartment 109 of the tray 101 against excessive heat generated by the oxygen absorber 103 in the second compartment 110 of the tray 101 during the oxidation process, which might otherwise damage or degrade the quality of the one or more products 102 contained in the container 100. For instance, in one or more embodiments, the partition 108 is configured to prevent the temperature in the first compartment 109 from increasing more than approximately 5° F. (approximately 3° C.) due to the heat created by the oxidation of the iron powder in the oxygen absorber 103. In one or more embodiments, the material of the partition 108 may be the same as the material of the one or more sidewalls 107 and the base 106 (e.g., the entire tray may be made out of the same material), but the partition 108 may have a thickness $T_1$ greater than a thickness $T_2$ of the one or more sidewalls 107 and/or a thickness $T_3$ of the base 106 of the tray 101. In one or more embodiments, the material of the partition 108 may be different than the material of the one or more sidewalls 107 and/or the material of the base 106. For instance, in one or more embodiments, the tray 101 may be made of plastic and the partition 108 may be coated or lined with a thermal barrier material (e.g., a metallic or ceramic layer) configured to mitigate against the transfer of heat from the second compartment 110 housing the oxygen absorber 103 to the first compartment 109 housing the one or more products 102. In one or more embodiments, the thermal barrier layer 116 may be on a portion (e.g., a wall) of the partition 108 facing toward the second compartment 110. In one or more embodiments, the thermal barrier layer 116 may be formed by metallizing at least a portion of the partition 108. In one or more embodiments, the partition 108 may have a higher specific heat than the one or more sidewalls 107 and/or the base 106 such that the partition 108 is configured to absorb a sufficient amount of the heat generated in the second compartment 110 by the oxidation process performed by the oxygen absorber 103 to prevent the one or more products 102 from being excessively heated.

In one or more embodiments, the size of the aperture 115 (e.g., the notch) may be selected to be large enough to permit air to flow from the first compartment 109, through the aperture 115 in the partition 108, and into the second compartment 110 where the oxygen will be consumed by the oxygen absorber 103, but not so large that heat generated by the oxidation process in the oxygen absorber 103 is excessively transferred to the one or more products 102 in the first compartment 109 through the aperture 115 in the partition 108. Additionally, in one or more embodiments, the aperture 115 in the partition 108 may not be so large that the oxygen absorber 103 can pass through the aperture 115 and move from the second compartment 110 into the first compartment 109.

In one or more embodiments, the container 100 may also include a removable lid or cover 117 configured to cover the removable film 105. The removable lid 117 is configured to protect the film 105 and prevent inadvertent damage to the film 105, such as puncturing, that could permit moisture-containing air to enter into the interior 104 of the tray 101, which could damage or degrade the quality of the one or more products 102 contained in the container 100. In one or more embodiments, the lid 117 may be configured to be removably secured to the tray 101 with a snap fit (e.g., the lid 117 may be configured to engage the one or more sidewalls 107 of the tray 101 with a snap fit). In one or more embodiments, the lid 117 may be configured to be removably secured to the tray 101 in any other suitable manner and/or with any other suitable mechanism, such as, for instance, with one or more straps or bands. In one or more embodiments, the lid 117 may be translucent or transparent to permit a user to view the one or more products 102 housed in the first compartment 109 and/or view the oxygen indicator 111 housed in the second compartment 110.

Figure 4:
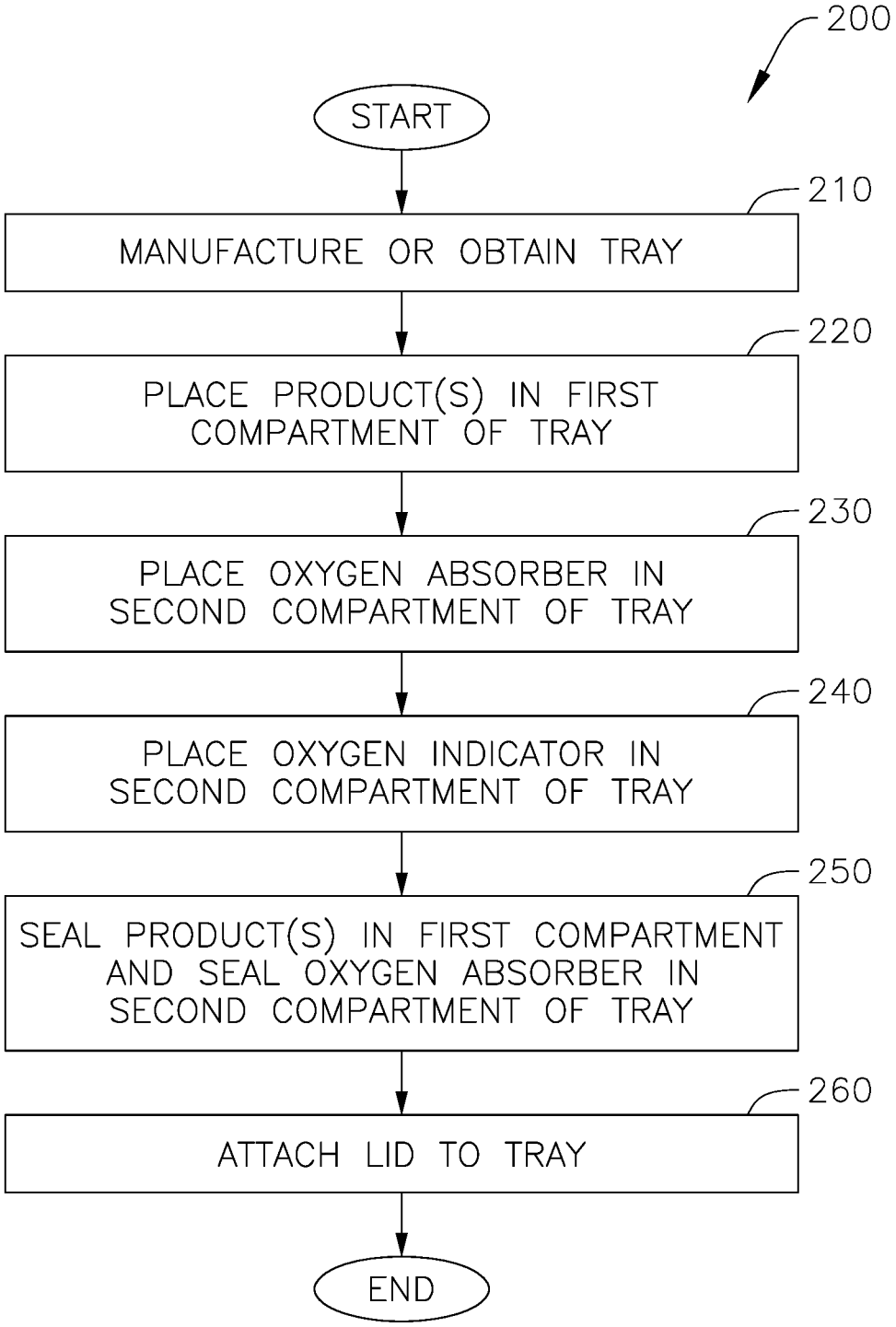
FIG. 4 is a flowchart illustrating tasks of a method of manufacturing a container according to one embodiment of the present disclosure.

FIG. 4 is a flowchart illustrating tasks of a method 200 of manufacturing a container according to one embodiment of the present disclosure. As illustrated in FIG. 4, the method 200 includes a task 210 of obtaining or manufacturing a tray. In one or more embodiments, the tray includes a first compartment and a second compartment separated from the first compartment by a partition. In one or more embodiments, the tray may be the same as or similar to the embodiment of the tray 101 illustrated in FIGS. 1-3C.

In the illustrated embodiment, the method 200 also includes a task 220 of placing one or more products (e.g., a product containing plant extract, such as nicotine) in the first compartment, and a task 230 of placing an oxygen absorber in the second compartment. In one or more embodiments, the method 200 may also include a task 240 of placing an oxygen indicator in the second compartment.

In one or more embodiments, the partition is breathable (e.g., contains one or more apertures) such that the first compartment is in fluid communication with the second compartment through the partition. When the air in the first compartment of the tray, which houses the one or more products, flows through the partition and into the second compartment of the tray, the ferrous carbonate (e.g., iron powder) in the oxygen absorber is exposed to moisture in the air, which causes the ferrous carbonate to oxidize (i.e., moisture in the air activates the ferrous carbonate). This oxidation process consumes oxygen in the air and thereby reduces the overall concentration of oxygen in the air trapped inside the interior of the tray. This oxidation process of the ferrous carbonate (e.g., iron powder) in the oxygen absorber also generates heat, which could damage or otherwise degrade the quality of the one or more products housed in the first compartment of the tray. In one or more embodiments, the partition functions as a thermal insulator and/or a heat sink configured to protect the one or more products contained in the first compartment of the tray against excessive heat generated by the oxygen absorber in the second compartment of the tray during the oxidation process. The configuration (e.g., shape, size, and material) of the partition may be the same as or similar to the configuration of the partition 108 described above with reference to the embodiment illustrated in FIGS. 1-3C. Moreover, as the air in the first compartment flows into the second compartment through the aperture in the partition and is consumed by the oxygen absorber, moisture in the air is drawn away from the one or more products housed in the first compartment, which protects the products against damage or degradation of quality that might otherwise occur if the products were exposed to oxygen and/or moisture. For instance, in one or more embodiments in which a cosmetic product (e.g., blush or eye shadow in a compact) is provided in the first compartment, drawing air away from the first compartment due to the consumption of oxygen by the oxygen absorber in the second compartment is configured to preserve the color of the cosmetic product (e.g., the oxygen absorber is configured to protect the cosmetic product from the oxygen in the container, which might otherwise degrade, tarnish, or change the color of the cosmetic.

In the illustrated embodiment, the method 200 also includes a task 250 of sealing the one or more products in the first compartment of the tray and sealing the oxygen absorber (and optionally the oxygen indicator) in the second compartment of the tray with a film. In one or more embodiments, the task 250 of sealing the one or more products and the oxygen absorber in the first and second compartments, respectively, may include heat sealing the film to the tray and/or bonding the film to the tray with an adhesive. The film is configured to prevent moisture-containing air from the surrounding atmosphere (the exterior of the container) from entering an interior (e.g., the first and second compartments) of the tray, which could damage or degrade the quality of the one or more products contained in the container. In one or more embodiments, the film may be removable to enable a user to access the one or more products housed in the first compartment of the tray. In one or more embodiments, the film may be the same as or similar to the film 105 described above with reference to the embodiment illustrated in FIGS. 1-3C.

In one or more embodiments, the method 200 may also include a task 260 of attaching a removable lid or cover to the tray. The lid is configured to protect the film and prevent inadvertent damage to the film, such as puncturing, that could permit moisture-containing air to enter into the interior of the tray, which could damage or degrade the quality of the one or more products contained in the container. In one or more embodiments, the configuration of the lid may be the same as or similar to the embodiment of the lid 116 described above with reference to the embodiment illustrated in FIGS. 1-3C. In one or more embodiments, the method 200 may not include the task 260 of attaching a lid to the tray.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims, and equivalents thereof.

What is claimed is:

1. A container comprising:

a tray comprising:

a base;

at least one sidewall extending in a first direction from the base; and at least one partition extending in the first direction from the base, the at least one partition dividing an interior of the tray into at least a first compartment and a second compartment adjacent to the first compartment; and at least one aperture in the at least one partition, wherein the first compartment is in fluid communication with the second compartment through the at least one aperture in the at least one partition;

an oxygen absorber in the second compartment;

a product in the first compartment, and a removable film covering the first compartment and the second compartment and preventing air from entering the interior of the tray, wherein the oxygen absorber is configured to reduce an amount of air in the first compartment by an oxidation reaction, and wherein the at least one aperture is configured to permit the air to flow into the second compartment to be oxidized by the oxygen absorber in the oxidation reaction and configured to prevent the product from being excessively heated by heat generated in the oxidation reaction.

2. The container of claim 1, wherein the removable film is sealed to each of the at least one sidewall and the at least one partition.

3. The container of claim 1, wherein the second compartment is volumetrically smaller than the first compartment.

4. The container of claim 1, wherein the at least one sidewall comprises:

a pair of opposing sidewalls; and a pair of opposing end walls connected to the pair of opposing sidewalls.

5. The container of claim 1, further comprising a removable lid covering the removable film.

6. The container of claim 1, further comprising an oxygen indicator in the one of the first compartment or the second compartment.

7. The container of claim 1, wherein the oxygen absorber comprises a mixture of iron powder and sodium chloride in a porous sachet.

8. The container of claim 7, wherein the mixture further comprises activated carbon.

9. The container of claim 1, wherein the product comprises a plant extract.

10. The container of claim 9, wherein the plant extract comprises nicotine.

11. The container of claim 1, wherein the product comprises a cosmetic.

12. The container of claim 1, wherein the removable film is translucent or transparent.

13. The container of claim 1, wherein the at least one partition comprises the same material as the at least one sidewall.

14. The container of claim 13, wherein the at least one partition is thicker than the at least one sidewall.

15. The container of claim 1, wherein the at least one partition has a higher specific heat than the at least one sidewall.

16. A method of manufacturing a container, the method comprising:

inserting at least one product into a first compartment of a tray, the tray comprising a base, at least one sidewall extending in a first direction from the base, and at least one partition extending in the first direction from the base, the at least one partition dividing an interior of the tray into at least the first compartment and a second compartment adjacent to the first compartment;

inserting an oxygen absorber into the second compartment of the tray separated from the first compartment by the at least one partition;

sealing the at least one product in the first compartment and the oxygen absorber in the second compartment with a removable film covering the first compartment and the second compartment; and forming at least one aperture in the partition, the at least one aperture placing the first compartment in fluid communication with the second compartment, wherein the first compartment is in fluid communication with the second compartment through the at least one aperture in the at least one partition, wherein the partition is configured to permit air in the first compartment to flow into the second compartment through the at least one aperture in the partition, wherein the oxygen absorber is configured to reduce an amount of the air in the first compartment by an oxidation reaction, wherein the at least one aperture is configured to permit the air to flow into the second compartment to be oxidized by the oxygen absorber in the oxidation reaction and configured to prevent the product from being excessively heated by heat generated in the oxidation reaction, and wherein the film is configured to prevent air outside of the container from entering the first compartment or the second compartment.

* * * * *